US012593919B2

(12) United States Patent
Deng

(10) Patent No.: US 12,593,919 B2
(45) Date of Patent: Apr. 7, 2026

(54) SEAT STRUCTURE WITH ADJUSTABLE SENSE OF SITTING

(71) Applicant: NEWTRAL FURNITURE TECHNOLOGY INC., Shenzhen (CN)

(72) Inventor: Jianbo Deng, Shenzhen (CN)

(73) Assignee: NEWTRAL FURNITURE TECHNOLOGY INC., Shenzhen (CN)

( * ) Notice: Subject to any disclaimer, the term of this patent is extended or adjusted under 35 U.S.C. 154(b) by 188 days.

(21) Appl. No.: 18/544,618

(22) Filed: Dec. 19, 2023

(65) Prior Publication Data

US 2025/0169610 A1 May 29, 2025

Related U.S. Application Data

(63) Continuation of application No. PCT/CN2023/136734, filed on Dec. 6, 2023.

(30) Foreign Application Priority Data

Nov. 24, 2023 (CN) ..... 202323185705.9

(51) Int. Cl.
*A47C 7/14* (2006.01)
*A47C 7/02* (2006.01)
*A47C 7/74* (2006.01)

(52) U.S. Cl.
CPC ..... *A47C 7/144* (2018.08); *A47C 7/021* (2013.01); *A47C 7/742* (2013.01)

(58) Field of Classification Search
CPC .. A47C 7/00; A47C 7/02; A47C 7/021; A47C 7/742; A17C 7/144; A37C 7/74
See application file for complete search history.

(56) References Cited

U.S. PATENT DOCUMENTS 5,779,318 A * 7/1998 O'Reilly ..... A47B 95/043 297/452.59
7,837,271 B2 * 11/2010 Galbreath ..... B60N 2/72 297/452.48
11,007,909 B2 * 5/2021 Styn ..... B60N 2/6009
11,659,933 B2 * 5/2023 Nelson ..... A47C 7/24 297/188.1
12,256,847 B1 * 3/2025 Wang ..... A47C 7/029
2002/0130538 A1 * 9/2002 Artsvelyan ..... B60N 2/787 297/227
2004/0255385 A1 * 12/2004 England ..... A47C 27/16 5/655.9

(Continued)

*Primary Examiner* — Chi Q Nguyen

(74) *Attorney, Agent, or Firm* — HOWARD M COHN and Associates, LLC

(57) ABSTRACT

A seat structure with an adjustable sense of sitting comprises a cover and a base plate, wherein an adjusting cavity is defined by the base plate and the cover; at least two soft inner layers different in hardness and breathability are arranged in the adjusting cavity, and the soft inner layers are at least two of a sponge cushion, a 3D mesh cushion and an air fiber cushion; and a cover body is provided with a zipper structure, which can be slidably unzipped to form an opening for adjusting the soft inner layers. The soft inner layers can be taken out via the opening, and users can place multiple soft inner layers in the adjusting cavity in different sequences as required to adjust the hardness and breathability of the seat structure to obtain suitable hardness and breathability so as to improve sitting comfort.

6 Claims, 6 Drawing Sheets

(56) References Cited

U.S. PATENT DOCUMENTS

| | | | | |
|---|---|---|---|---|
| 2006/0175883 | A1* | 8/2006 | Neustat | A47C 31/11 297/229 |
| 2016/0174715 | A1* | 6/2016 | Nelson | A47C 17/045 297/440.14 |
| 2019/0291534 | A1* | 9/2019 | Arata | B60N 2/5635 |
| 2019/0380460 | A1* | 12/2019 | Marsh | A45F 4/02 |
| 2021/0212557 | A1* | 7/2021 | Weitzner | A61B 1/00154 |
| 2023/0232988 | A1* | 7/2023 | Law | A47C 7/24 297/452.42 |

* cited by examiner

SEAT STRUCTURE WITH ADJUSTABLE SENSE OF SITTING

BACKGROUND OF THE INVENTION

1. Technical Field

The invention relates to the field of structures of ergonomic chairs, in particular to a seat structure with an adjustable sense of sitting.

2. Description of Related Art

The emphasis of users on sitting health leads to a rapid development of ergonomic chairs derived based on the ergonomic theory. The ergonomic chairs have a variety of functions, including a lean-back adjustment function, a backrest up-down adjustment function and a waist rest up-down adjustment function.

The cushion of traditional ergonomic chairs remains in contact with users, so the comfort of the cushion is always an important criterion when users purchase ergonomic chairs. There are generally two types of cushions. Some cushions have a cotton interlayer which can provide a good wrapping and fitting effect, and such cushions can better fit the features of human bodies with time; however, the breathability of such cushions is poor. Other cushions have an elastic mesh surface, and have the greatest advantage of good appearance and breathability. However, such cushions have a high production cost, and an unsatisfactory service life due to the use of mesh materials. These two types of cushions cannot realize hardness adjustment, leading to poor user experience. Therefore, a more reasonable seat structure is urgently needed to overcome these defects.

BRIEF SUMMARY OF THE INVENTION

The invention provides a solution to the technical problems that existing ergonomic chairs cannot realize hardness adjustment and are poor in user experience due to the incompatibility of cost and breathability.

To fulfill the above objective, the invention provides a seat structure with an adjustable sense of sitting, comprising a cover and a base plate, wherein an outer edge of the base plate is fixedly connected to a cover opening of the cover to form an adjusting cavity, and multiple groups of heat-dissipation holes are formed in a side, away from the cover, of the base plate and connected to the adjusting cavity; at least two soft inner layers different in hardness and breathability are arranged in the adjusting cavity, and the soft inner layers are at least two of a sponge cushion having a surface provided with multiple groups of heat-dissipation through-holes, a 3D mesh cushion and an air fiber cushion;

wherein, a cover body of the cover is provided with a zipper structure, and the zipper structure is able to be slidably unzipped to form an opening for adjusting the soft inner layers; and multiple soft inner layers are arranged in the adjusting cavity in different sequences to adjust hardness and breathability of the seat structure.

As an improved solution of the invention, an accommodating groove for accommodating legs is formed in a side, close to the cover, of the base plate.

As an improved solution of the invention, a mounting groove is formed in the side, away from the cover, of the base plate, and the edge for forming the cover opening of the cover is fixed in the mounting grooves to form the adjusting cavity.

As an improved solution of the invention, when the soft inner layer is the sponge cushion, multiple groups of heat-dissipation through-holes are formed in the surface of the sponge cushion.

As an improved solution of the invention, the cover is further provided with an elastic part, and the elastic part is arranged around a cover body of the cover.

As an improved solution of the invention, a bottom of the cover covers the soft inner layer at the bottom to form an abutting area, and the zipper structure is located between the elastic part and the abutting area.

As an improved solution of the invention, the seat structure further comprises a fan assembly, a ventilation cavity is defined jointly by edges of multiple soft inner layers, and the fan assembly is received in the ventilation cavity.

Compared with the prior art, the invention has the following beneficial effects: the seat structure with an adjustable sense of sitting comprises a cover and a base plate, the base plate seals a cover opening of the cover to form an adjusting cavity, and multiple groups of heat-dissipation holes are formed in a side, away from the cover, of the base plate and connected to the adjusting cavity; at least two soft inner layers different in hardness and breathability are arranged in the adjusting cavity, and the soft inner layers are at least two of a sponge cushion having a surface provided with multiple groups of heat-dissipation through-holes, a 3D mesh cushion and an air fiber cushion; and a cover body of the cover is provided with a zipper structure, which can be slidably unzipped to form an opening for adjusting the soft inner layers. Heat can be dissipated through the heat-dissipation holes, the soft inner layers can be taken out via the opening, and users can place multiple soft inner layers in the adjusting cavity in different sequences as required to adjust the hardness and breathability of the seat structure and can better adjust the seat structure according to their requirements to obtain suitable hardness and breathability to improve the sitting comfort; and the entire seat structure is easy to machine and low in production cost.

REFERENCE SIGNS OF MAIN ELEMENTS

1, cover; 11, abutting area; 12, elastic part; 13, zipper structure;

2, base plate; 21, heat-dissipation hole; 22, mounting groove; 23, accommodating area; 3, soft inner layer;

31, heat-dissipation through-hole; 32, fan assembly; 33, ventilation cavity.

DETAILED DESCRIPTION OF THE INVENTION

To more clearly explain the invention, the invention will be further described below in conjunction with accompanying drawings.

In the following description, details of selected embodiments are given to provide a deeper understanding of the invention. Obviously, the embodiments in the following description are merely illustrative ones, and are not all possible ones of the invention. It should be understood that these specific embodiments are merely used for explaining the invention, and are not intended to limit the invention.

It should be understood that terms "include" and/or "comprise" used in this specification are intended to indicate the existence of features, entities, steps, operations, elements or components referred to, and do not exclude the existence or addition of one or more other features, entities, steps, operations, elements, components, or combinations thereof.

The cushion of traditional ergonomic chairs keeps in contact with users, so the comfort of the cushion is always an important criterion when users purchase ergonomic chairs. There are generally two types of cushions. Some cushions have a cotton interlayer which can provide a good wrapping and fitting effect, and such cushions can better fit the features of human bodies with time; however, the breathability of such cushions is poor, and the cotton interlayer of the cushions in the market cannot be disassembled by users after sale, so users cannot clearly determine the material of the cotton interlayer; and if the interlayer is made from shoddy cotton, the health of users will be severely affected in long-term use. The other cushions have an elastic mesh surface, have the greatest advantage of good appearance and breathability, and save users from the trouble of shoddy cotton. However, such cushions have a high production cost, and an unsatisfactory service life due to the use of mesh materials; and the mesh materials are mounted by tension, so the cushions with the elastic mesh surface cannot well fit users, leading to a poor sense of sitting. These two types of cushions have both advantages and disadvantages; however, none of these two types of cushions can realize hardness adjustment, and users cannot adjust the seat to a desired position to improve the long-term sitting comfort according to their preference. Therefore, is a more reasonable seat structure is urgently needed to overcome these defects.

Figure 1:
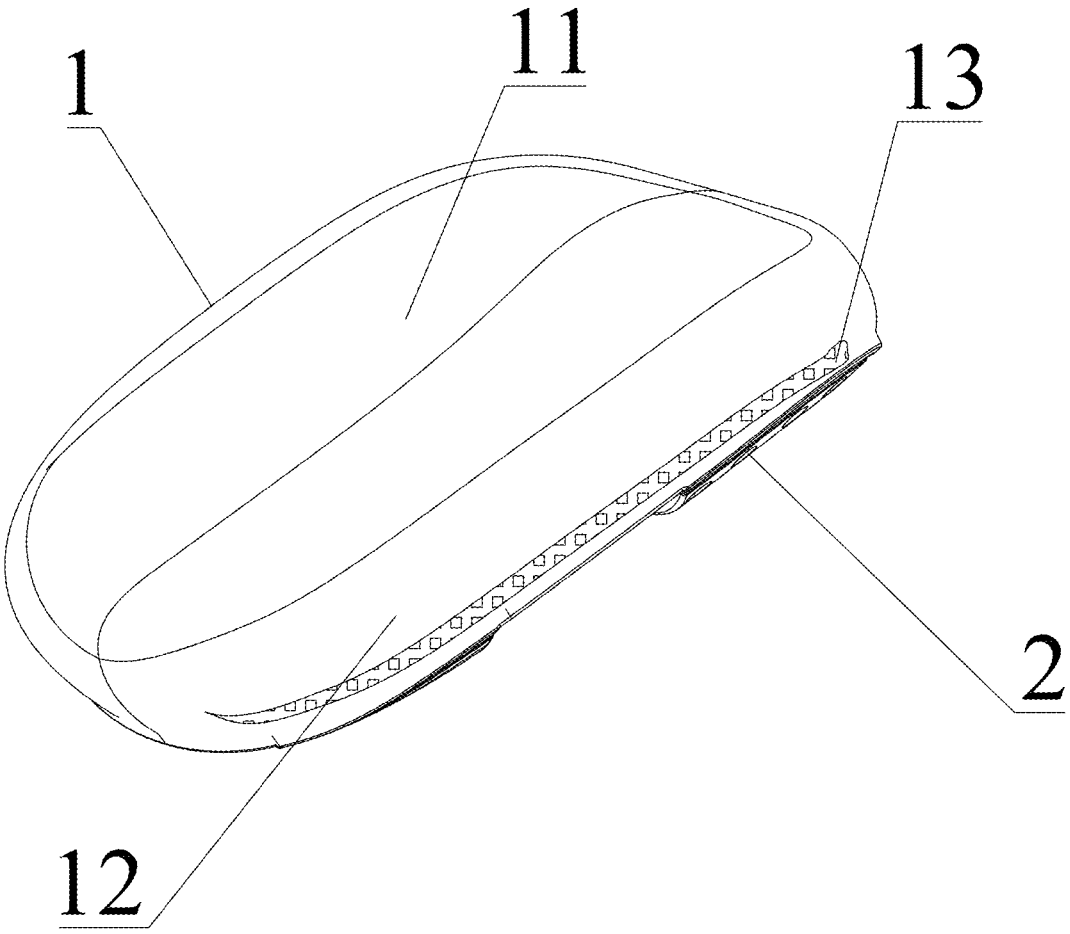
FIG. 1 is a three-dimensional view of the invention.
Figure 2:
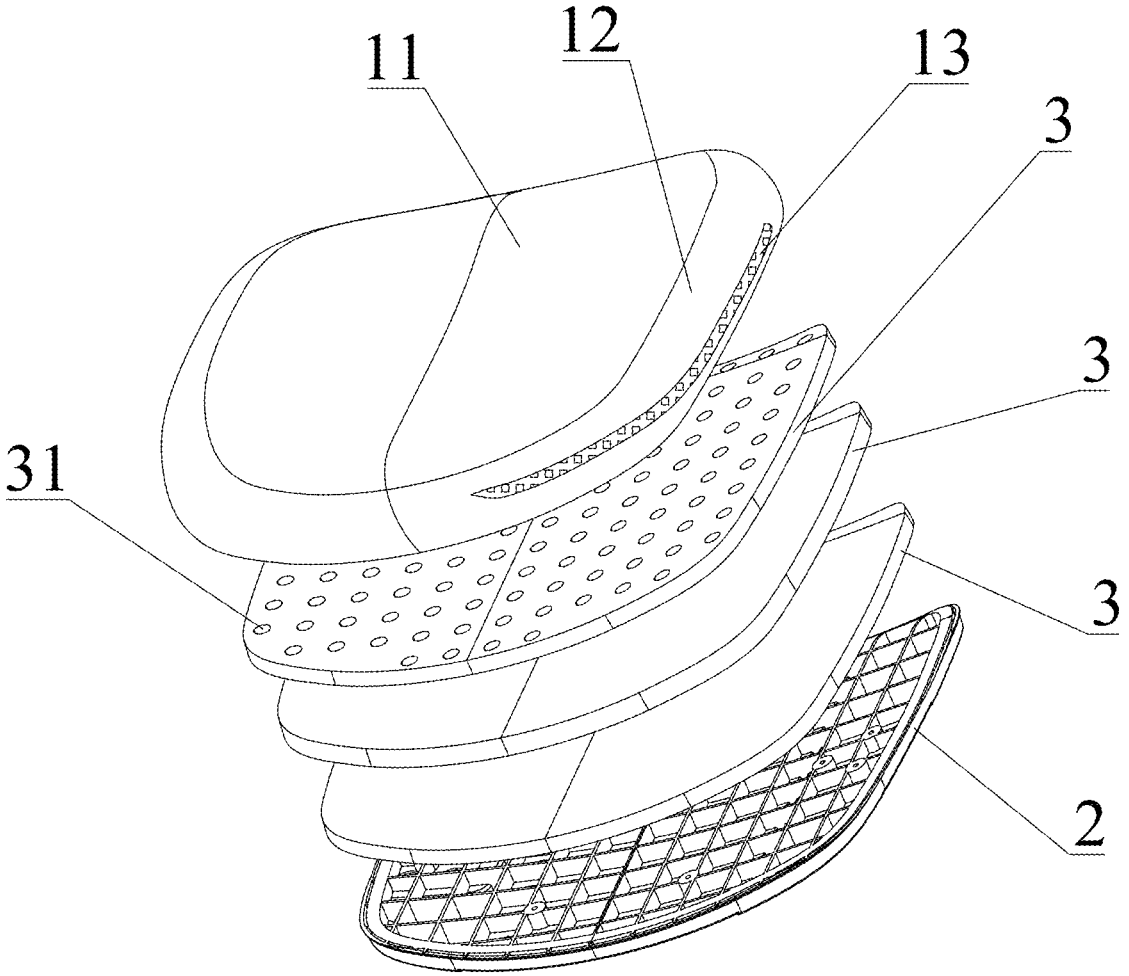
FIG. 2 is an exploded view of the invention.
Figure 3:
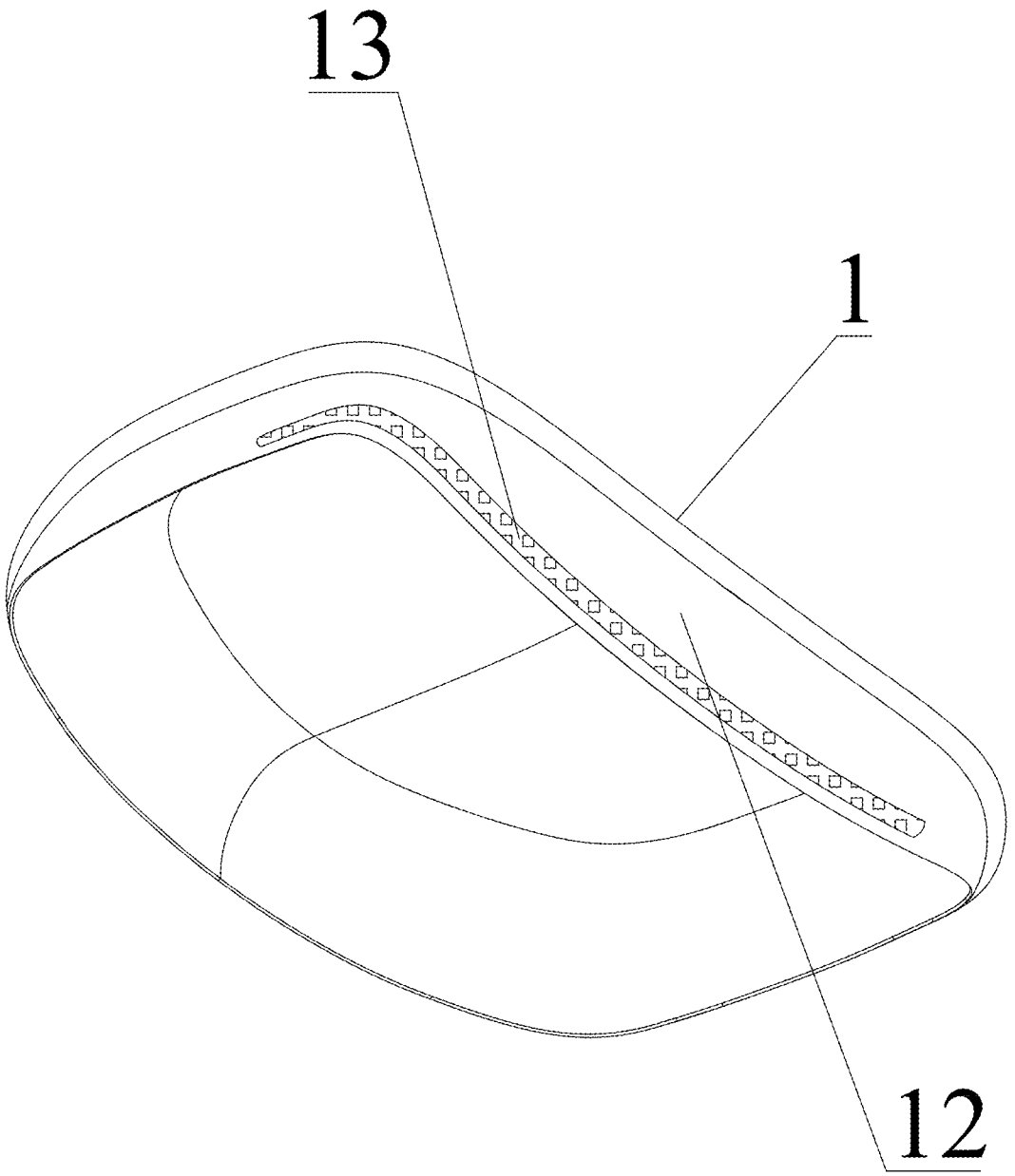
FIG. 3 is a three-dimensional view of a cover according to the invention.
Figure 4:
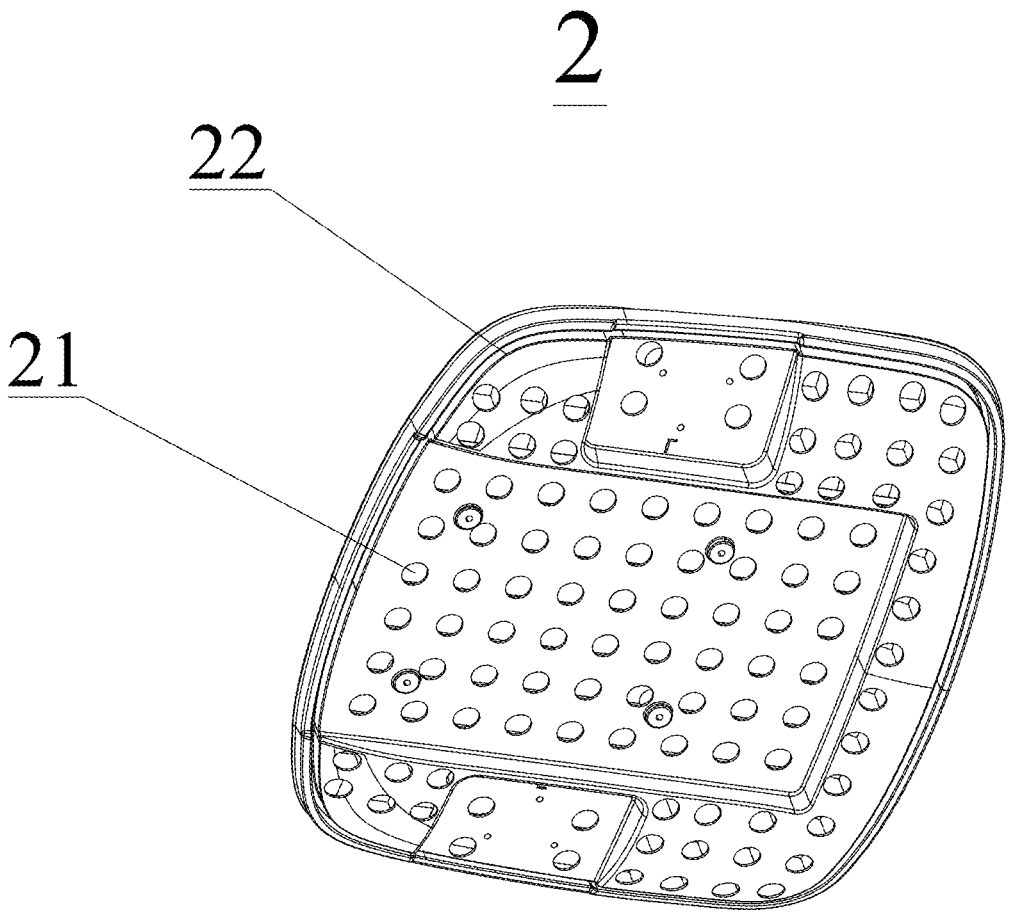
FIG. 4 is a three-dimensional view of a base plate according to the invention.
Figure 5:
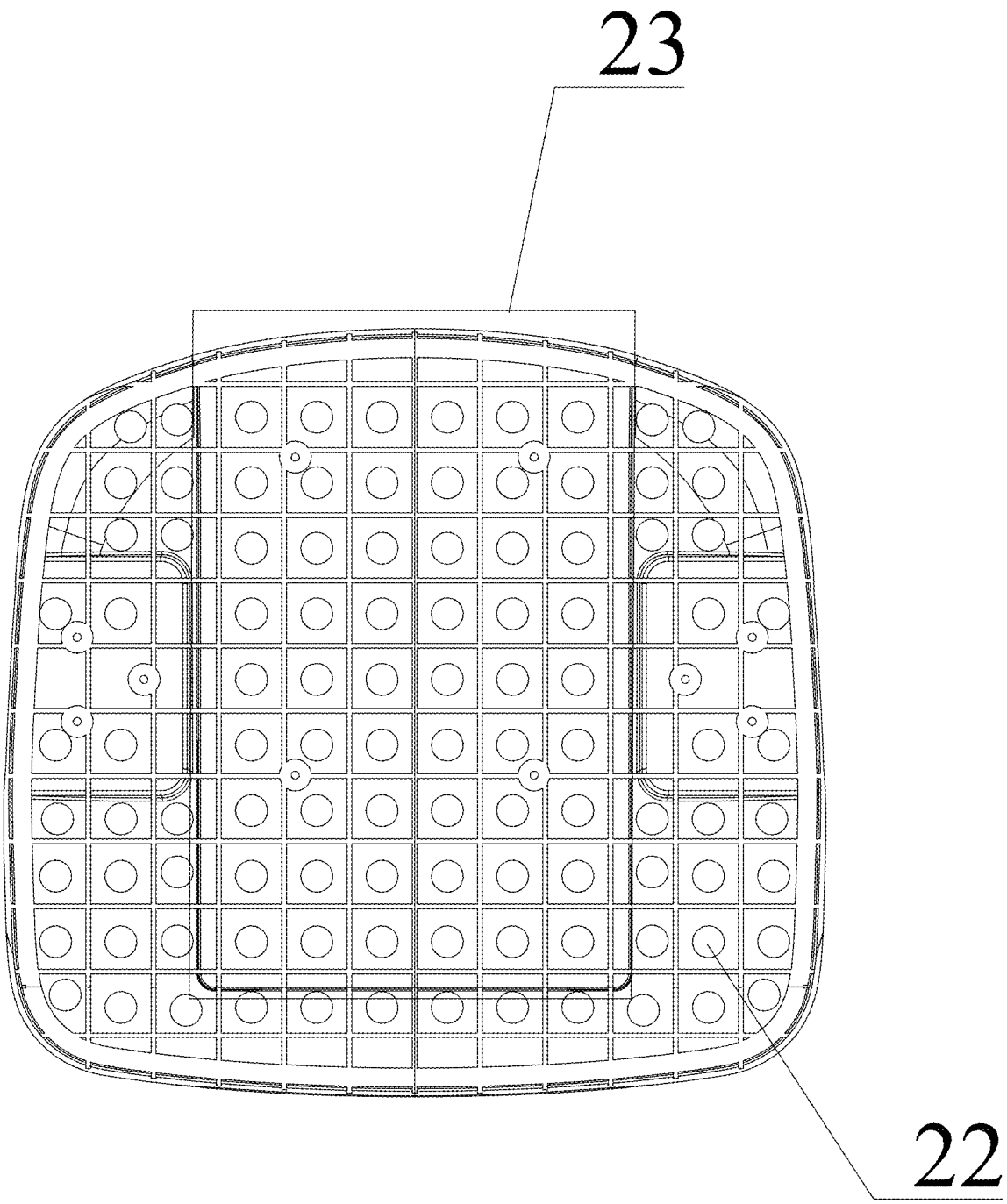
FIG. 5 is a bottom view of the base plate according to the invention.
Figure 6:
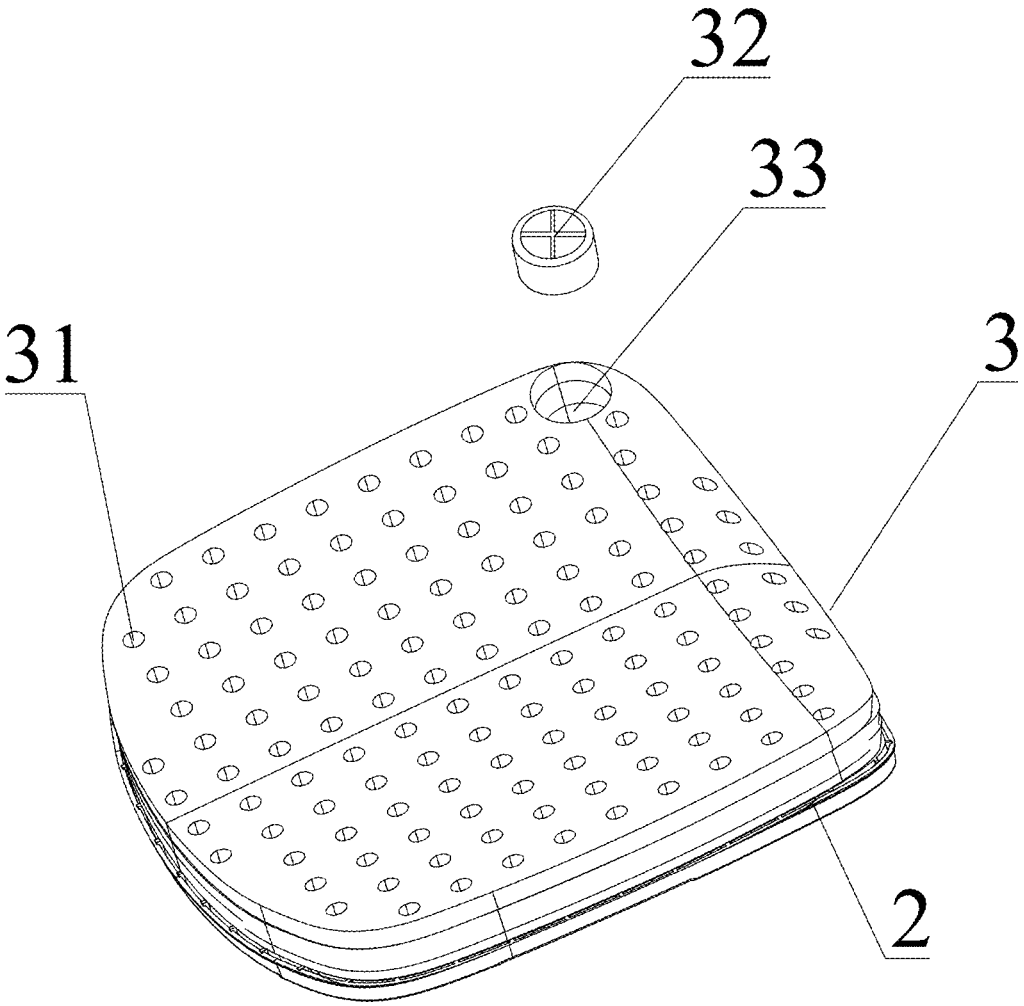
FIG. 6 is a structural diagram of a soft inner layer according to the invention.

To solve the above-mentioned technical problems, the application provides a seat structure with an adjustable sense of sitting. Referring to FIG. 1-FIG. 6, the seat structure comprises a cover 1 and a base plate 2, wherein an outer edge of the base plate 2 is fixedly connected to a cover opening of the cover 1 to form an adjusting cavity, and at least two soft inner layers 3 different in hardness and breathability are arranged in the adjusting cavity; wherein, a cover body of the cover 1 is provided with a zipper structure 13, and the zipper structure 13 can be slidably unzipped to form an opening for adjusting the soft inner layers 3. In use of the seat structure provided by the application, the soft inner layers can be taken out via the opening, and users can place multiple soft inner layers 3 in the adjusting cavity in different sequences as required to adjust the hardness and breathability of the seat structure; users can better adjust the seat structure according to their requirements to obtain suitable hardness and breathability and keep themselves in fit with the seat structure, that is, users can adjust the filling sequence of the soft inner layers made from different materials to set the heat-dissipation performance and softness of the seat structure so as to obtain optimal sitting comfort; the entire seat structure is easy to machine and low in production cost; and furthermore, users can check the materials of the soft inner layers 3 through the zipper structure 13 to avoid shoddy cotton.

In this embodiment, multiple groups of heat-dissipation holes 21 are formed in a side, away from the cover 1, of the base plate 2 and connected to the adjusting cavity. It can be easily understood that the overall heat-dissipation performance of the seat structure is further improved through multiple groups of heat-dissipation holes 21. Specifically, a certain amount of heat will be accumulated on the seat structure when users sit on the seat structure for a long time, and ventilation and heat dissipation can be realized through the heat-dissipation holes 21, thus improving long-term sitting comfort and preventing users from feeling stuffy and sweating.

In this embodiment, an accommodating groove for accommodating legs is formed in a side, close to the cover 1, of the base plate 2. It can be easily understood that the accommodating groove can form an accommodating area 23 for accommodating the legs of users, thus further improving the comfort.

In the aspect of the assembly of the base plate 2 and the cover 1, a mounting groove 22 is formed in the side, away from the cover 1, of the base plate 2, and the edge for forming the cover opening of the cover 1 is fixed in the mounting groove 22 to form the adjusting cavity. It can be easily understood that the edge for forming the cover opening of the cover 1 can be fixedly connected to the mounting groove 22 with an adhesive or by sewing with a needle, or threaded pressing to form the adjusting cavity where the soft inner layers 3 are placed as filling materials.

In the aspect of the selection of soft layers, in this embodiment, the soft inner layers 3 are at least two of a sponge cushion, a 3D mesh cushion and an air fiber cushion. It can be easily understood that the sponge cushion, the 3D mesh cushion and the air fiber cushion are all options of cushion inners in the art. Further, for example, the soft inner layers 3 are the sponge cushion and the air fiber cushions; when users use the seat structure in summer or hot weather, the air fiber cushion is placed above the sponge cushion, is in contact with users through the cover 1, and can guarantee the breathability and prevent stuffiness, and the hardness realized by the sponge cushion and the air fiber cushion can be guaranteed; and if the hardness needs to be further improved, a 3D mesh cushion can be added to improve the overall hardness. For another example, when users use the seat structure in winter or cold weather, the sponge cushion can be placed on the air fiber cushion and the 3D mesh cushion to guarantee the softness and wrapping performance for users in the sitting position; although the sponge cushion has poor breathability, it can provide a better warming effect and is more suitable for winter or other similar application scenarios; and if the hardness needs to be further reduced, the air fiber cushion can be pulled out. More preferably, when the soft inner layer 3 is the sponge cushion, multiple groups of heat-dissipation through-holes are formed in the surface of the sponge cushion. In another preferred solution, the cover is made from a 3D breathable mesh cloth to further improve the overall heat-dissipation performance of the seat structure; and the soft inner layer may be an elastic cushion in which springs are arranged, to further improve the breathability and hardness.

In this embodiment, the cover 1 is provided with an elastic part 12, and the elastic part 12 is arranged around the cover body of the cover 1. It can be easily understood that the elastic part 12 allows the receiving space of the adjusting cavity to change according to the number of the soft inner layers 3, such that the soft inner layers 3 can be better fixed; and in actual implementation, the elastic part 12 may be made from a cloth with good elasticity, such as stretchy nylon or elastic fiber, and is sewn on the cover body.

As for the assembly details of the zipper structure 13, it can be understood that the bottom of the cover 1 covers the soft inner layer 3 at the bottom to form an abutting area 11; and the zipper structure 13 is located on a side, away from the abutting area 11, of the elastic part 12, such that users can open the abutting area 11 more easily to uncover the adjusting cavity to control the filling sequence of the soft inner layers 3.

In this embodiment, the seat structure further comprises a fan assembly 32, a ventilation cavity 33 is defined jointly by edges of multiple soft inner layers 3, and the fan assembly 32 is received in the ventilation cavity 33. This implementation is clearly recorded in Patent Publication No. CN212972463U, and thus will not be repeated here.

The invention has the following advantages:

(1) The soft inner layers can be taken out via the opening, and users can place multiple soft inner layers in the adjusting cavity in different sequences as required to adjust the hardness and breathability of the seat structure and can better adjust the seat structure according to their requirements to obtain suitable hardness and breathability and keep themselves in fit with the seat structure; the entire seat structure is easy to machine and low in production cost;

(2) Furthermore, users can check the materials of the soft inner layers through the zipper structure to avoid shoddy cotton.

Several specific embodiments of the invention are disclosed above, but the invention is not limited to the above embodiments. All variations that can be obtained by any skilled in the art should fall within the protection scope of the invention.

What is claimed is:

1. A seat structure with an adjustable sense of sitting, comprising a cover and a base plate, an outer edge of the base plate being fixedly connected to a cover opening of the cover to form an adjusting cavity, and multiple groups of heat-dissipation holes being formed in a side, away from the cover, of the base plate and connected to the adjusting cavity; at least two soft inner layers different in hardness and breathability being arranged in the adjusting cavity, and the at least two soft inner layers being at least two of a sponge cushion having a surface provided with multiple groups of heat-dissipation through-holes, a 3D mesh cushion and an air fiber cushion;

wherein, a cover body of the cover is provided with a zipper structure, and the zipper structure is able to be slidably unzipped to form an opening for adjusting the at least two soft inner layers; and the at least two soft inner layers are arranged in the adjusting cavity in different sequences to adjust hardness and breathability of the seat structure.

2. The seat structure with an adjustable sense of sitting according to claim 1, wherein an accommodating groove for accommodating legs is formed in a side, close to the cover, of the base plate.

3. The seat structure with an adjustable sense of sitting according to claim 1, wherein a mounting groove is formed in the side, away from the cover, of the base plate, and the edge for forming the cover opening of the cover is fixed in the mounting grooves to form the adjusting cavity.

4. The seat structure with an adjustable sense of sitting according to claim 1, wherein the cover is further provided with an elastic part, and the elastic part is arranged around a cover body of the cover.

5. The seat structure with an adjustable sense of sitting according to claim 4, wherein a bottom of the cover covers the soft inner layer at the bottom to form an abutting area, and the zipper structure is located between the elastic part and the abutting area.

6. The seat structure with an adjustable sense of sitting according to claim 1, wherein the seat structure further comprises a fan assembly, a ventilation cavity is defined jointly by edges of the at least two soft inner layers, and the fan assembly is received in the ventilation cavity.

* * * * *